US010172502B1

(12) United States Patent
Hall

(10) Patent No.: US 10,172,502 B1
(45) Date of Patent: Jan. 8, 2019

(54) CHILDING TRAINING TOILET AND METHOD TO USE

(71) Applicant: Stacy Hall, Exeter, MO (US)

(72) Inventor: Stacy Hall, Exeter, MO (US)

( * ) Notice: Subject to any disclaimer, the term of this patent is extended or adjusted under 35 U.S.C. 154(b) by 0 days.

(21) Appl. No.: 15/968,416

(22) Filed: May 1, 2018

Related U.S. Application Data

(63) Continuation-in-part of application No. 15/697,334, filed on Sep. 6, 2017.

(51) Int. Cl.
*A47K 11/06* (2006.01)

(52) U.S. Cl.
CPC ..... *A47K 11/06* (2013.01)

(58) Field of Classification Search
CPC ..... A47K 11/02; A47K 11/023; A47K 11/06; A47K 11/04; A47K 11/08
See application file for complete search history.

(56) References Cited

U.S. PATENT DOCUMENTS 5,978,976 A * 11/1999 Chai ..... A47K 11/04 4/483
2008/0083061 A1* 4/2008 Dubiel ..... A47K 11/06 4/484
2008/0263756 A1* 10/2008 Marsden ..... A47K 11/06 4/239
2010/0043132 A1* 2/2010 Viglietta ..... A47K 11/06 4/483
2011/0061157 A1* 3/2011 Goergen ..... A47K 11/06 4/483
2012/0084908 A1* 4/2012 Dunn ..... A47K 11/06 4/483
2012/0084909 A1* 4/2012 Dunn ..... A47K 11/06 4/483
2013/0283515 A1* 10/2013 Schilpp ..... A47K 11/06 4/483
2014/0068851 A1* 3/2014 Rosser ..... A47K 11/04 4/483
2014/0259354 A1* 9/2014 Sundberg ..... A47K 11/04 4/483
2015/0082532 A1* 3/2015 Marsden ..... A47K 11/06 4/483

* cited by examiner

*Primary Examiner* — Janie Loeppke
(74) *Attorney, Agent, or Firm* — Sanchelima & Associates, P.A.; Christian Sanchelima; Jesus Sanchelima

(57) ABSTRACT

A toilet training device having a flange extending from a cutout in the base assembly that includes an opening that engages an anchoring member located on the underside of a seat assembly and when engaged prevents a child from removing the removable seat assembly from the training toilet base.

14 Claims, 11 Drawing Sheets

CHILDING TRAINING TOILET AND METHOD TO USE

OTHER RELATED APPLICATIONS

The present application is a continuation-in-part of the pending U.S. patent application Ser. No. 15/697,334, filed on Sep. 6, 2017, which is hereby incorporated by reference.

BACKGROUND OF THE INVENTION

Field of the Invention

The present invention relates generally to a child's training toilet and more specifically to a child's training toilet that incorporates a secure attachment mechanism for preventing the child from removing the waste container from the training toilet base.

Description of the Related Art

Several designs for toilet training devices have been designed in the past. None of them, however, include an attachment means for securely attaching the waste container to the toilet base in the novel way taught by the present invention.

Applicant believes that a related reference corresponds to U.S. patent published application No. US 2014/0259354 filed by Sundberg for a toilet base assembly having an inner surface, a waste container assembly, a bottom surface and an attachment assembly. Another related reference is US Patent Application Publication 2008/0263756 filed by Marsden having a fastener member that includes a central portion that is wider than its upper and lower portions. The present invention is distinguishable from the Sundberg and the Marsden reference individually or in combination because Applicant's invention includes fastening members that are more secure than either reference.

Applicant's fastener members implement a flange having an opening configured to securely receive a male clip member that is passed through the opening in the flange and prevent the waste basin from being removed from the toilet bowl. The present invention's design is not only different from the Sundberg and Marsden references but there is also no motivation to develop Applicant's invention in light of the prior art that currently exists in the public domain. The Applicant's novel design allows users to quickly release the anchoring member from within the opening in the flange for easy and fast release of the waste basin from the toilet bowl when a user wants to clean it.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a toilet training device that includes secure fastening means to secure the waste container to the toilet base.

It is another object of this invention to provide a toilet training device with a waste container that is securely attached to a toilet base thereby preventing a child from separating the two and creating a mess.

It is still another object of the present invention to provide a toilet training device with waste container mounting means that are easy to install without compromising the structural integrity of the toilet training device.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
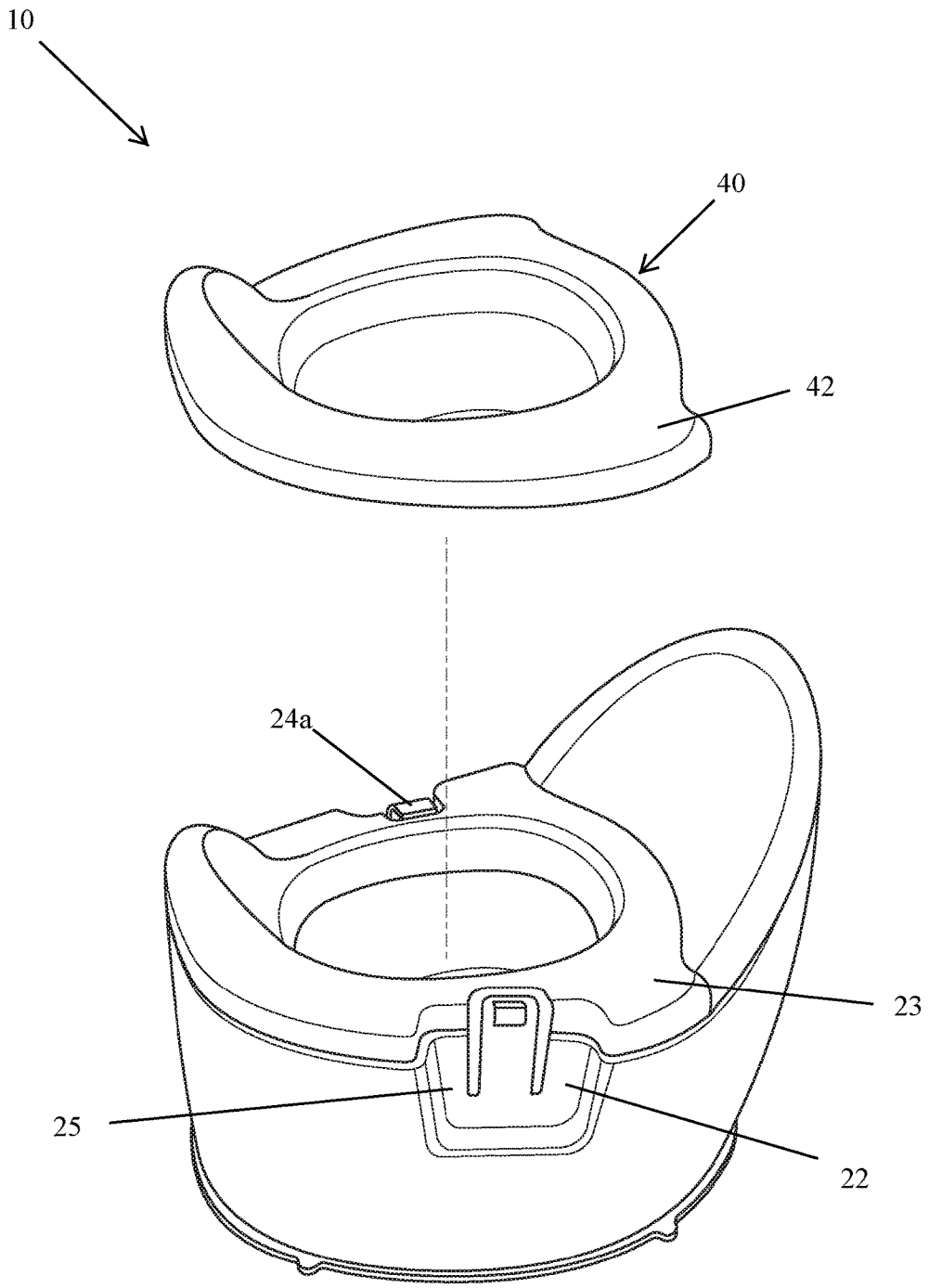
FIG. 1 represents an isometric view of the toilet training device showing the seat assembly 40 separated from toilet base assembly 20.
Figure 2:
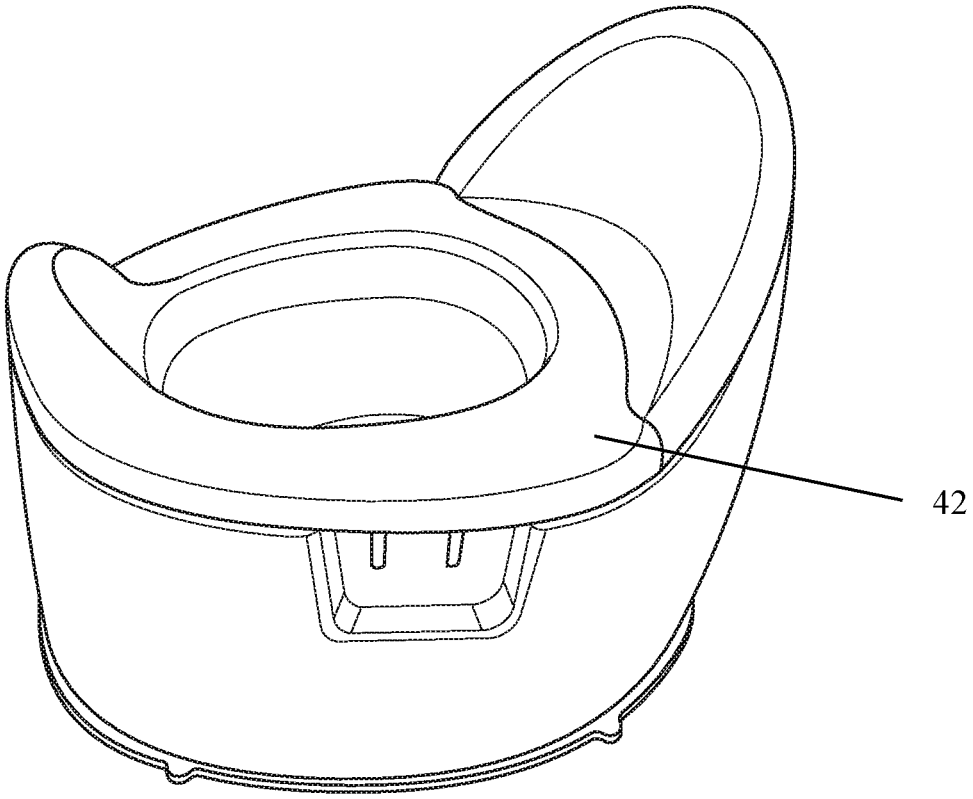
FIG. 2 shows an isometric view of the toilet training device 10 where seat assembly 40 has been mounted to toilet base assembly 20.
Figure 3:
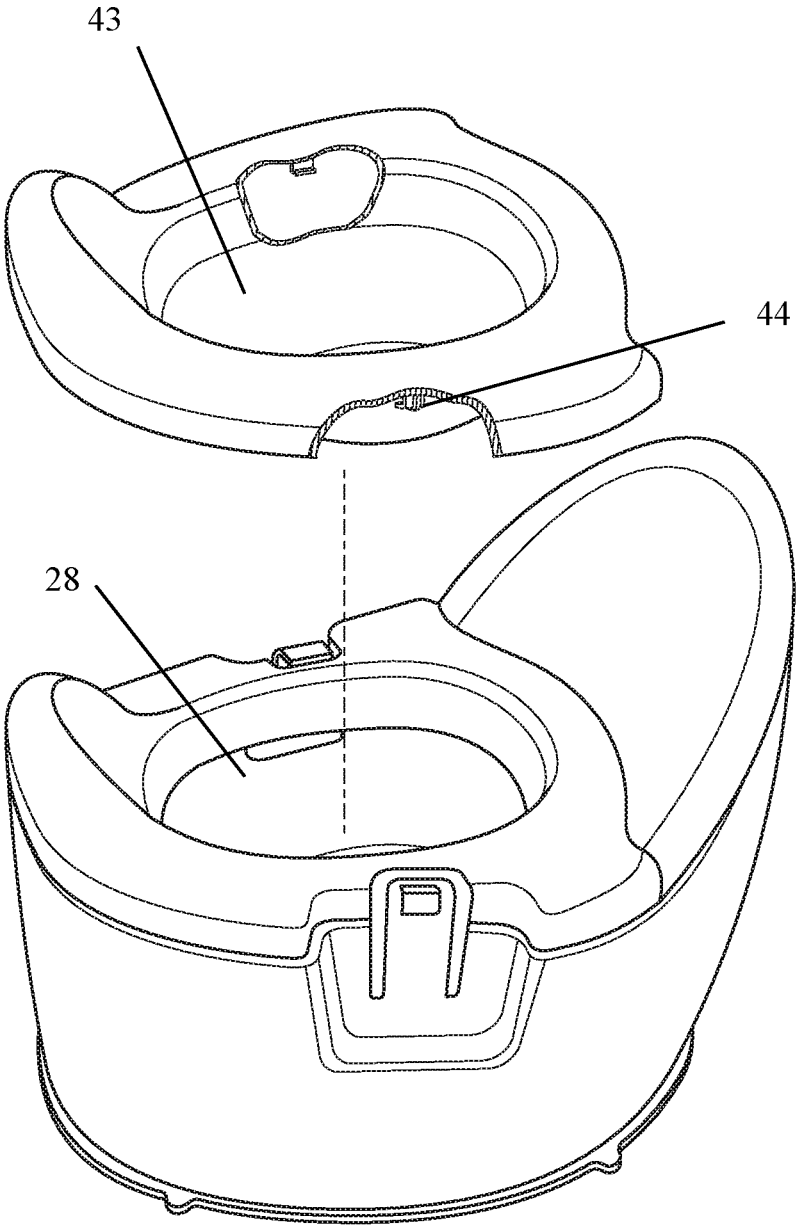
FIG. 3 illustrates an isometric view of the present invention wherein waste container 40 is removed from toilet base assembly 20 and a cut out of seat assembly 40 is seen to show the location of anchoring members 44.
Figure 4:
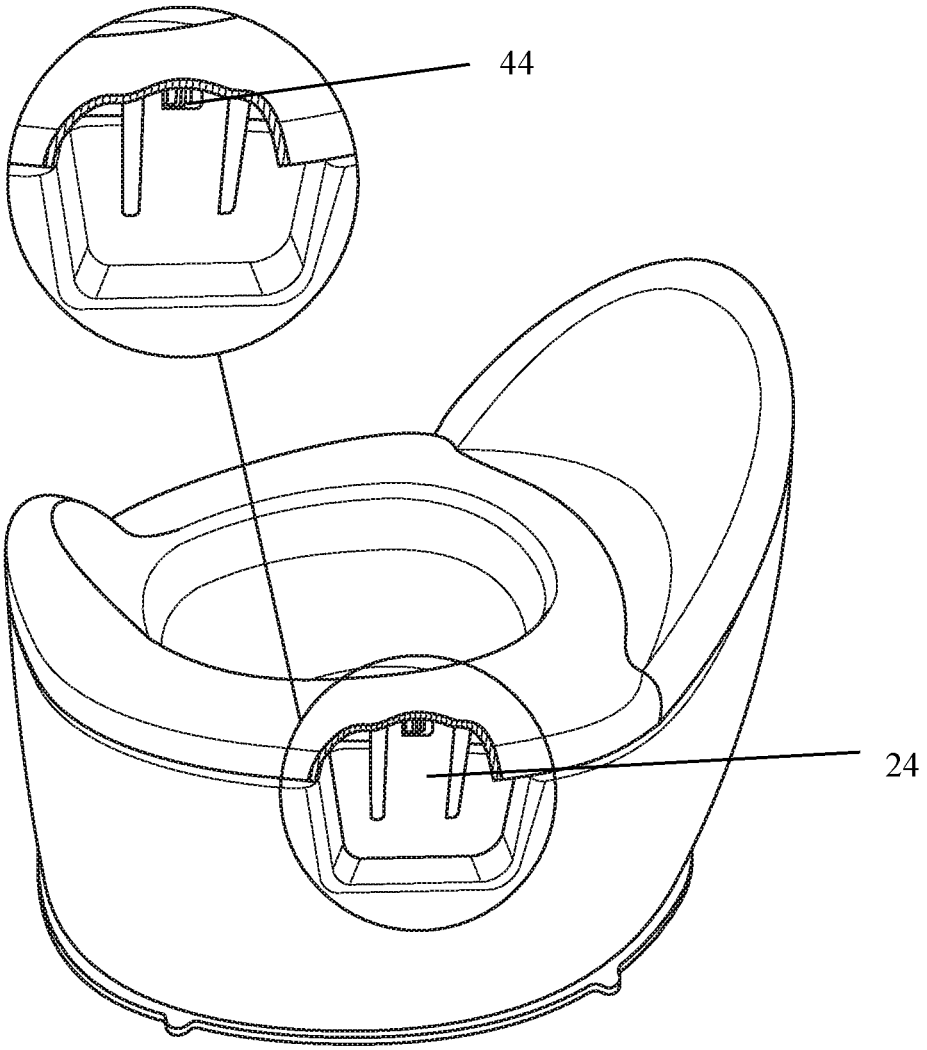
FIG. 4 shows an isometric view of the present invention wherein an enlarged close-up view of flange 24 is shown engaging base assembly 20 to seat assembly 40 using anchoring members 44.
Figure 5:
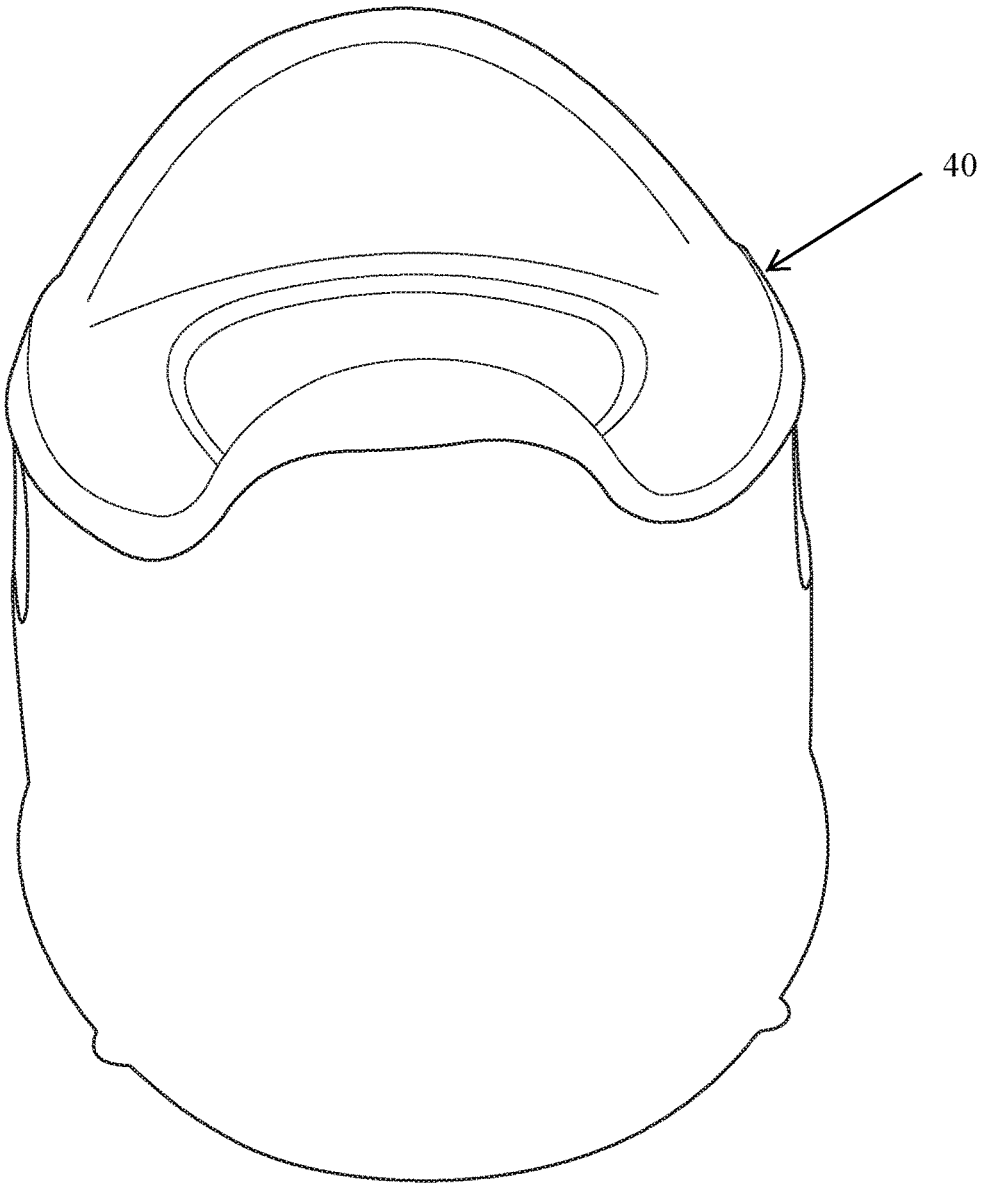
FIG. 5 is a representation of a front isometric view of the present invention.
Figure 6:
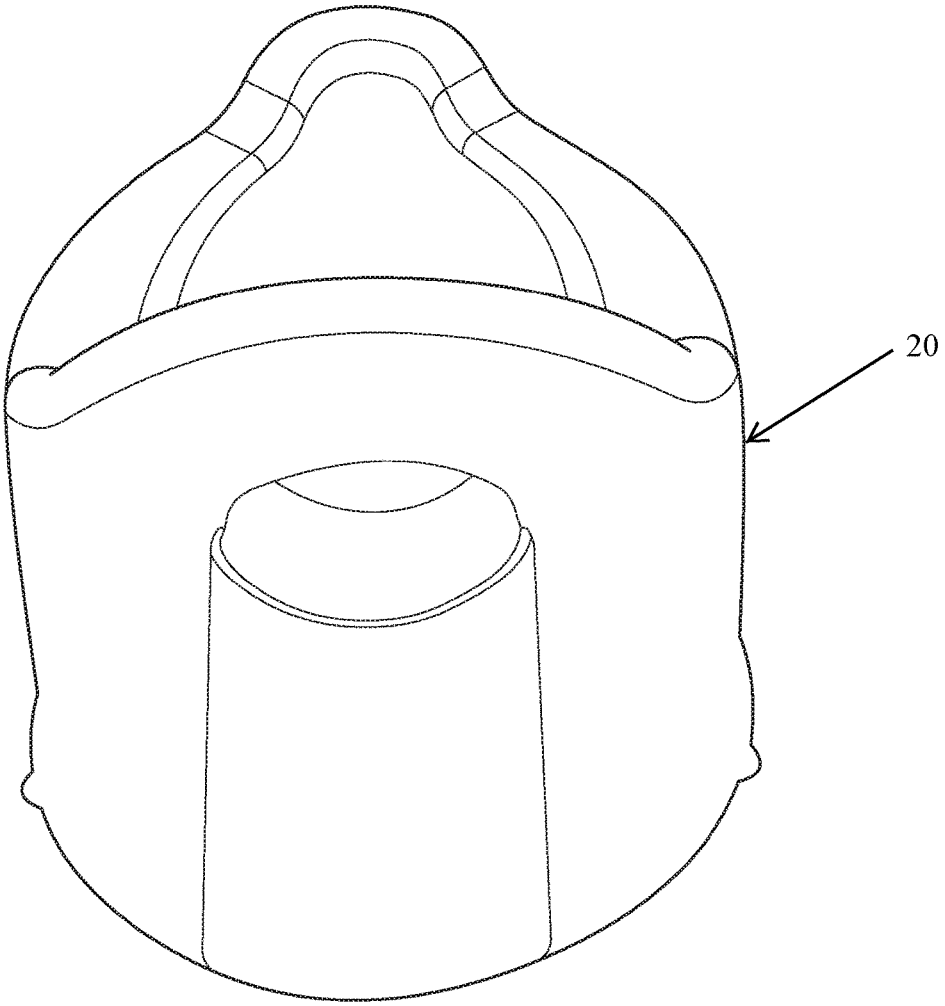
FIG. 6 depicts a rear isometric view of the present invention.
Figure 7:
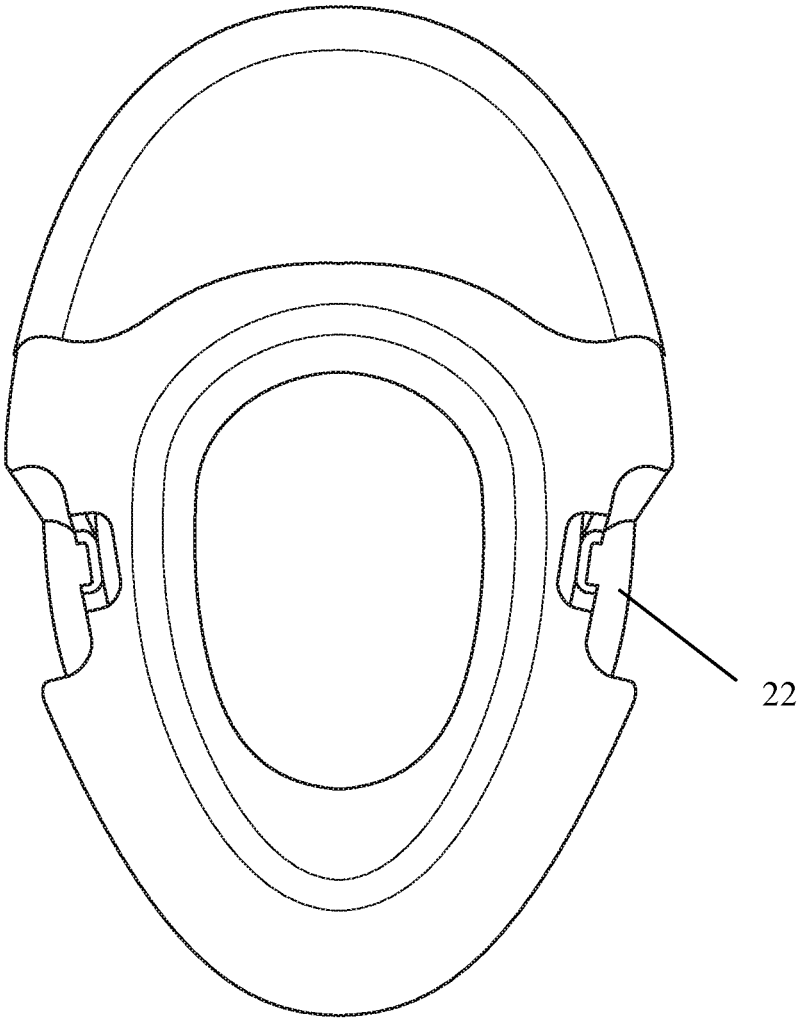
FIG. 7 is an illustration of a top plan view of the present invention having seat assembly 40 removed showing cutouts 22 and the top of flanges 24.
Figure 8:
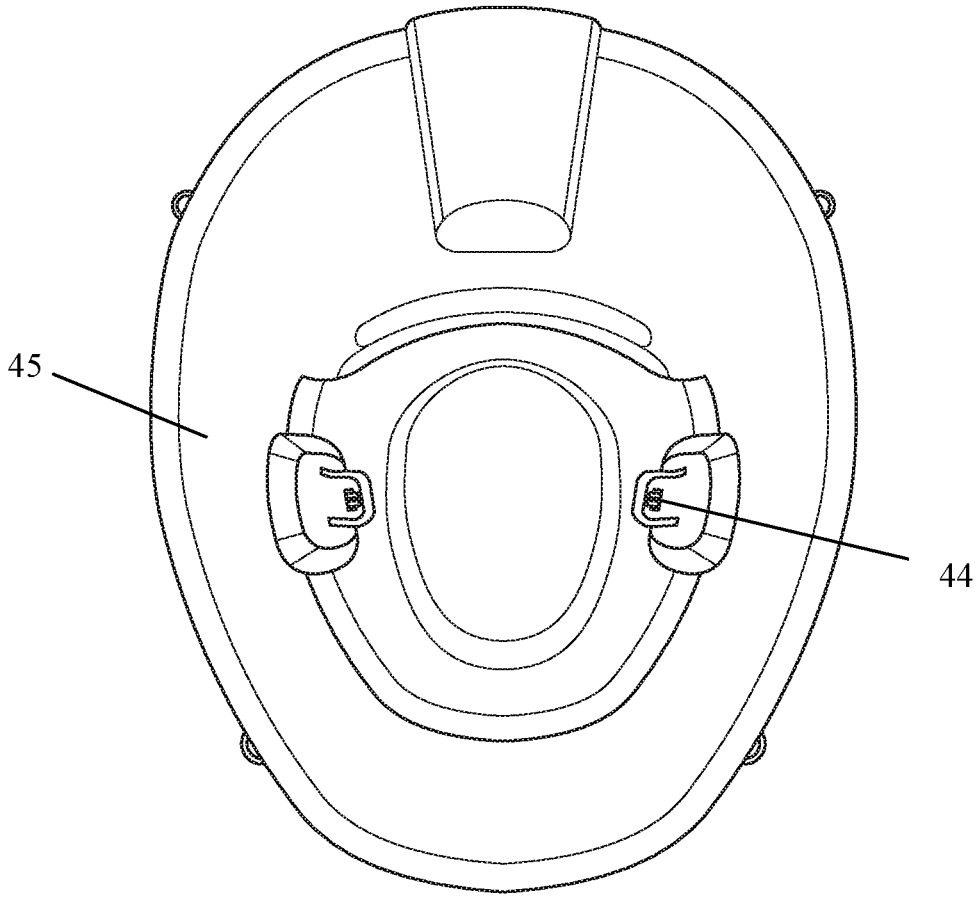
FIG. 8 is a bottom plan view of toilet base assembly 20 connected to seat assembly 40.
Figure 9:
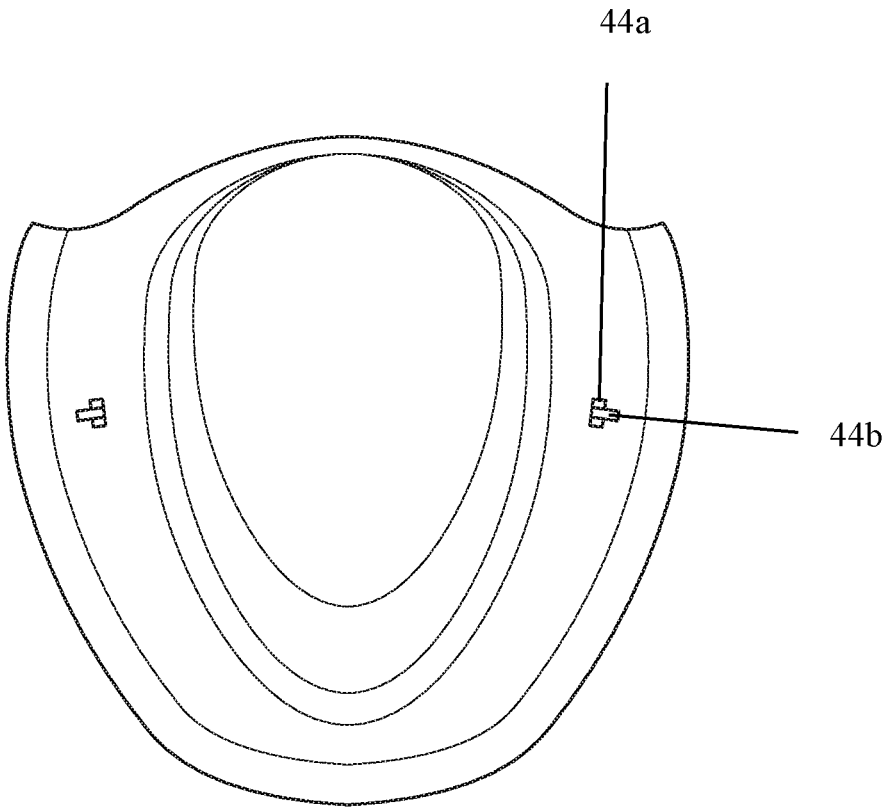
FIG. 9 is a bottom view of seat assembly 40 showing anchoring members 44 on the bottom surface of seat 42.
Figure 10:
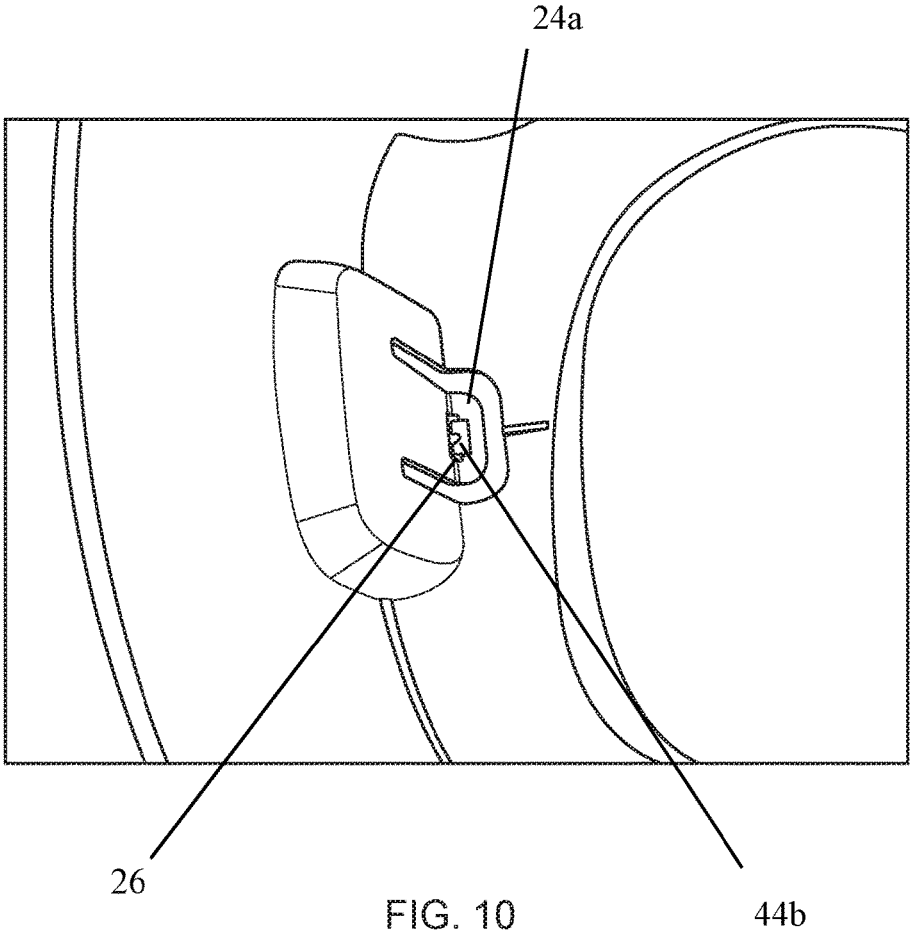
FIG. 10 is a close up of seat assembly 40 showing anchoring member 44 passing through opening 26 on flange 24.
Figure 11:
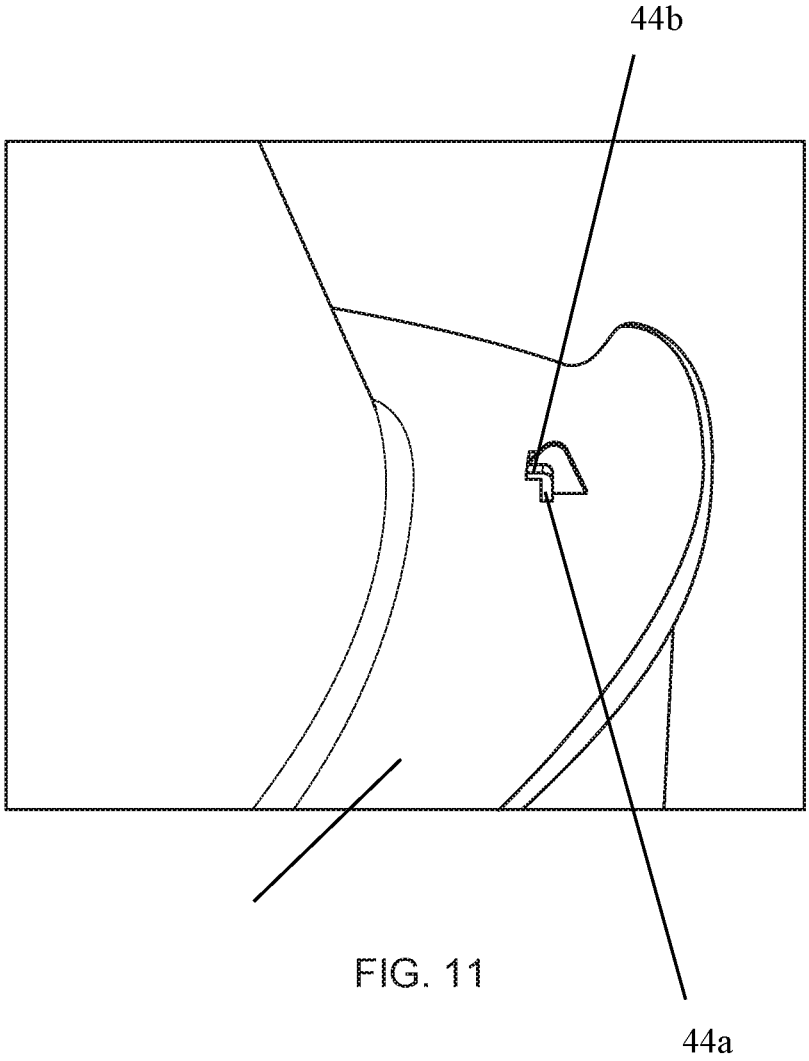
FIG. 11 is a close-up view of anchoring member 44 mounted to the bottom surface of seat 42.

The present invention 10 includes a toilet base assembly 20 and a seat assembly 40. Toilet base assembly 20 has a toilet seat configuration for young children learning how to potty train. Toilet base assembly 20 includes a circumference with a back portion that extends upwards from the circumference defining a backrest for the child. The front portion includes a lip that rises from the toilet base's circumference and is designed to prevent a child from sliding forward on the seat.

The base of toilet base assembly 20 includes a non-slip surface integrally or removably mounted thereon to keep the potty training device from sliding on the ground, thereby keeping the child securely seated thereon. Along the circumference of toilet base assembly 20 there are cutouts 22 that extend into the thickness of the toilet base a predetermined distance. Toilet base assembly also includes a base seat 23 that extends like annularly around the base. Cutout 22 can also extend into the base seat 23. Cutout 22 is made so that flanges 24 can be positioned therein extending from the bottom of the recessed wall 25 within cutout 22. Flanges 24 include anchoring member receiving opening 26 at their top end that is configured to receive anchoring member 44, further described below.

At least two sides of toilet base assembly 20 can include flanges 24. There is a spacing 27 surrounding flange 24 to allow for a user to push flange 24 in when a user desires to release toilet base 20 from seat assembly 40. Flange 24 includes stopper member 24*a* that extends from flange 24. In one embodiment, stopper member 24*a* extends substantially perpendicular from flange 24 and acts to prevent anchoring member 44 from being lifted out of opening 26.

Seat assembly 40 includes a seat 42 that matches the shape of base seat 23 so that it can be placed flush thereon. Seat assembly 40 includes a waste basin 43 located in the center of said seat and extends downwards a predetermined depth. Seat assembly 40 includes anchoring members 44 extending from seat bottom surface 45. In a preferred embodiment, there are as many anchoring members 44 as flanges 24. When seat 42 is placed over base seat 23 flange, opening 26 is covered by lip 46 on seat 42. Toilet base assembly 20 includes cavity 28 that is configured to receive and house the depth of waste basin 43.

The engagement between toilet base 20 and seat assembly 40 is done using anchoring members 44 being placed within opening 26 as seat 42 is lowered on base seat 23. A predetermined amount of downward pressure is needed so that anchoring members 44 can overcome the bias from flanges 24 so that anchoring members 44 can both be nestled within openings 26. Anchoring members 44 can be located sufficiently inside the periphery of seat 42 so that it can be comfortably positioned over base seat 23. Cutout 22 cuts into the thickness of the toilet base an amount that cooperates with the placement of the corresponding anchoring members. If a child attempts to lift seat assembly 40 from toilet base assembly 20, anchoring members 44 are be stopped from moving upwards, thereby separating both assemblies, because of stopper 24*a*.

Anchoring members 44 are prevented from being freed by inward lateral movement of seat 42 since anchoring members are inserted from the outside of flange 24 and therefore either flange 24 or its opposite, coacting flange will prevent lateral movement. The only way to free anchoring members 44 from flanges 24 to separate seat 42 from toilet base assembly 20 is to push both flanges 24 inwardly and simultaneously until the distal, horizontal end of anchoring member 44 is no longer inserted inside opening 26. At that point stopper 24*a* will no longer be able to restrict the upwards movement of seat 42 as it is separated from toilet base assembly 20.

The present invention can include a gap on the rear side of the backrest to be used as a handle to transport the device. The device can be created of any suitable material such as plastic. Anchoring members 44 can include a vertical component 44*a* that extends from bottom surface 45 and a perpendicular horizontal portion 44*b* which is inserted into opening 26 when locking toilet base assembly 20 with seat assembly 40.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A toilet training device, comprising:

a. a toilet base assembly having a circumferential thickness including two lateral sides each having a cutout that extends into the circumferential thickness of the toilet base assembly, said cutouts each creating a recessed wall extending into said circumferential thickness;

b. a pliable flange located at each said recessed wall, said flanges each include a flange opening, said flanges including a top and sides;

c. a spacing encircling the top and sides of said flanges adapted to allow said flanges to move inwardly and outwardly therein;

d. a seat assembly including a waste basin and a seat having a bottom surface;

e. at least two anchoring members on said bottom surface positioned at a location that cooperates with placing said anchoring members simultaneously within said flange openings;

f. said flanges each include a stopper member adjacent to and above said flange openings and substantially perpendicular to said flanges;

g. said anchoring members adapted to be passed through said flange openings a predetermined distance until said anchoring member come into abutting engagement with said stopper members, each of said anchoring members is positioned at a relationship to said flange openings so that a predetermined amount of force must be applied to overcome the bias of said flanges, thereby permitting each of said anchoring members to be nestled inside said flange openings, thereby defining a locked position; and h. said flanges adapted to being pushed simultaneously and inwardly until said anchoring members are no longer within said flange openings and said anchoring members are no longer in abutting engagement with said stopper members, thereby defining an unlocked position.

2. The toilet training device of claim 1 wherein said toilet base assembly includes a base seat member having a width, said two lateral sides have a thickness substantially perpendicular to said base seat member, said cutouts cut into the thicknesses of said lateral sides and the width of said base seat member.

3. The toilet training device of claim 2 wherein said thicknesses of the two cutouts are defined as a lateral cutout, said lateral cutouts remain uncovered when said seat assembly is mounted to said toilet base assembly.

4. The toilet training device of claim 1 wherein said anchoring members each include a vertical member extending away from said bottom surface a predetermined distance, said anchoring members each include a perpendicular engagement member mounted thereto.

5. The toilet training device of claim 4 wherein said perpendicular engagement members each are passed through said flange openings in the locked configuration.

6. The toilet training device of claim 4 wherein said anchoring members each include a support members mounted behind in abutting engagement with said vertical member and said perpendicular engagement members, said support members are angled towards said basin.

7. The toilet training device of claim 5 wherein said support members each have a portion above said perpendicular engagement members.

8. The toilet training device of claim 1 wherein the toilet training device is made of plastic.

9. The toilet training device of claim 1 wherein said seat assembly includes a splash guard.

10. The toilet training device of claim 1 wherein said toilet base assembly includes a backrest.

11. The toilet training device of claim 1 wherein said toilet base assembly includes a base seat and said seat is mounted flush to said base seat.

12. The toilet training device of claim 11 wherein said base seat and said seat each have a front end, said front ends curved upwards from the remainder of said seat and base seat to define a partition adapted to keep a child from falling from the toilet training device.

13. The toilet training device of claim 1 wherein said toilet base assembly includes a rear side having an oval opening, said oval opening adapted to be used as a handle.

14. The toilet training device of claim 1 wherein said cutouts remain uncovered.

* * * * *